US008950608B2

(12) United States Patent
DeJong et al.

(10) Patent No.: US 8,950,608 B2
(45) Date of Patent: Feb. 10, 2015

(54) UNIVERSAL ADAPTER SYSTEM FOR BOTTLE CONTAINERS USING A DISPENSING PUMP OR CAP

(71) Applicants: Chad A. DeJong, Temple City, CA (US); Amy Y. Lin, Temple City, CA (US)

(72) Inventors: Chad A. DeJong, Temple City, CA (US); Amy Y. Lin, Temple City, CA (US)

( * ) Notice: Subject to any disclaimer, the term of this patent is extended or adjusted under 35 U.S.C. 154(b) by 0 days.

(21) Appl. No.: 14/044,777

(22) Filed: Oct. 2, 2013

(65) Prior Publication Data

US 2014/0103004 A1 Apr. 17, 2014

Related U.S. Application Data

(60) Provisional application No. 61/713,603, filed on Oct. 14, 2012.

(51) Int. Cl.

| | |
|---|---|
| ***B65D 41/04*** | (2006.01) |
| ***B65D 51/24*** | (2006.01) |
| ***B65D 47/08*** | (2006.01) |
| ***A45D 34/00*** | (2006.01) |
| *B65D 41/16* | (2006.01) |
| *A45D 34/04* | (2006.01) |

(52) U.S. Cl.

CPC ..... *B65D 51/249* (2013.01); *B65D 47/0857* (2013.01); *A45D 34/00* (2013.01); *A45D 34/04* (2013.01); *A45D 2034/002* (2013.01)

USPC ..... 215/228; 220/256.1; 220/287

(58) Field of Classification Search

USPC ..... 215/228; 220/259.1, 287

See application file for complete search history.

(56) References Cited

U.S. PATENT DOCUMENTS

| | | | |
|---|---|---|---|
| 683,768 | A | 10/1901 | Innes |
| 815,558 | A | 3/1906 | Rosier |
| 1,454,728 | A | 5/1923 | Cruse |
| 4,646,944 | A | 3/1987 | Sanderson |
| 4,838,466 | A | 6/1989 | Holmstrom |
| 4,932,561 | A | 6/1990 | Boxall |
| 5,292,035 | A | 3/1994 | Millar |
| 5,385,272 | A | 1/1995 | Aoun |
| 5,794,904 | A | 8/1998 | Hackley |
| 5,992,662 | A | 11/1999 | Gelardi et al. |
| 6,095,374 | A | 8/2000 | Ricard et al. |
| 6,098,256 | A | 8/2000 | Poussard |
| D431,467 | S | 10/2000 | Dooney et al. |
| D431,476 | S | 10/2000 | Tanaka |
| D440,154 | S | 4/2001 | Ricard et al. |
| 6,390,315 | B1 | 5/2002 | Giddings et al. |

(Continued)

FOREIGN PATENT DOCUMENTS

| | | |
|---|---|---|
| CN | 102001608 | 4/2011 |

*Primary Examiner* — Mickey Yu
*Assistant Examiner* — Niki Eloshway
(74) *Attorney, Agent, or Firm* — Knobbe Martens Olson & Bear, LLP

(57) ABSTRACT

A universal adapter assembly system for container bottles using existing dispensing pumps or existing bottle caps includes a plurality of adapter members. Each adapter member is sized to receive and couple to a container bottle having a different sized bottle neck from which the dispensing pump or bottle cap is removed. The system also has a base member with a body sized to fit and releasably couple to each of the plurality of adapter members. The base member has a cap movable between an open position and a closed position relative to the base member body, the cap having an outer portion configured to support the container bottle in an upside down orientation on a supporting surface.

15 Claims, 9 Drawing Sheets

(56) References Cited

U.S. PATENT DOCUMENTS

| | | | | |
|---|---|---|---|---|
| 6,877,626 | B2 * | 4/2005 | Sherrod | 215/319 |
| 6,880,730 | B2 | 4/2005 | Fulwood | |
| 7,114,628 | B2 | 10/2006 | Guevara | |
| 7,857,172 | B2 * | 12/2010 | Harvey | 222/321.1 |
| 8,087,547 | B1 | 1/2012 | Lindsey | |
| 2004/0124170 | A1 * | 7/2004 | Sherrod | 215/319 |
| 2006/0151420 | A1 * | 7/2006 | Espenschied | 215/276 |
| 2007/0267425 | A1 * | 11/2007 | Gill | 220/709 |
| 2008/0110929 | A1 * | 5/2008 | Stanley Traasdahl et al. | 222/109 |
| 2009/0120894 | A1 | 5/2009 | Kario et al. | |
| 2009/0188885 | A1 * | 7/2009 | Nichols | 215/272 |
| 2010/0126956 | A1 | 5/2010 | Cero, Jr. | |
| 2010/0290828 | A1 | 11/2010 | Cook | |
| 2011/0121102 | A1 | 5/2011 | Clarke | |
| 2011/0290678 | A1 * | 12/2011 | Simonian et al. | 206/219 |
| 2012/0006821 | A1 * | 1/2012 | Sanford | 220/254.1 |

* cited by examiner

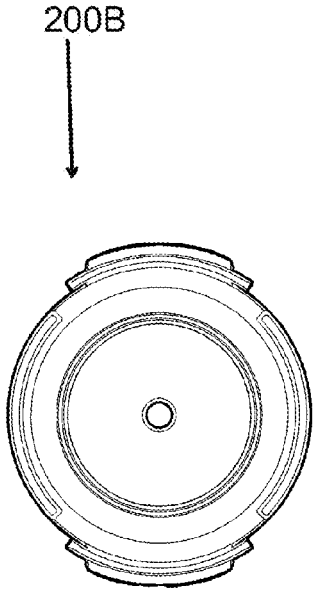
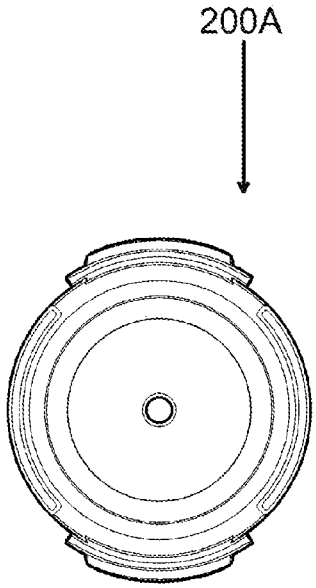
FIG. 5A FIG. 6A
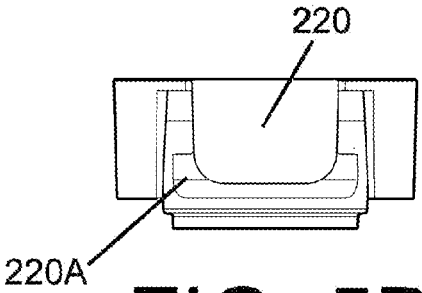
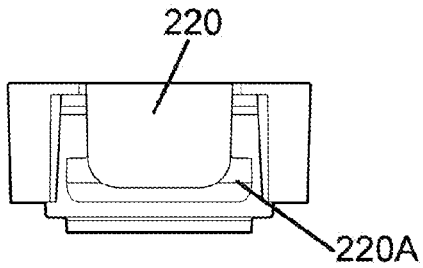
FIG. 5B FIG. 6B
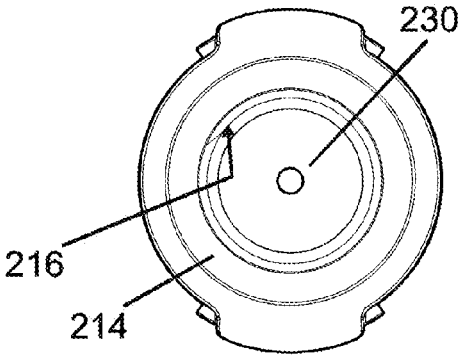
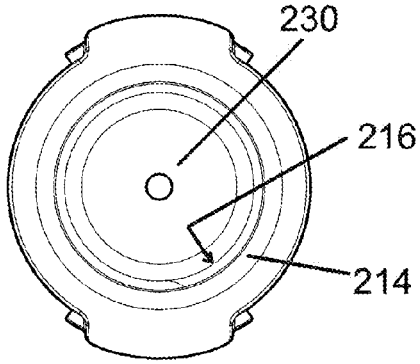
FIG. 5C FIG. 6C 200A, 200B
202
220

212
214
216
230

SECTION A-A
SCALE 2 : 1
224
200A, 200B

UNIVERSAL ADAPTER SYSTEM FOR BOTTLE CONTAINERS USING A DISPENSING PUMP OR CAP

CLAIM FOR PRIORITY

The present application claims priority to U.S. Provisional Patent Application No. 61/713,603, filed Oct. 14, 2012.

BACKGROUND

1. Field

The invention relates to bottles having caps or dispensing pumps (e.g., for lotion bottles) and more particularly to a universal bottle pump adaptor for use with container bottles of various sizes.

2. Description of the Related Art

Bottles are used to dispense various consumer goods (e.g., hand lotion, shampoo, hand soap) using a pump actuated by the user to dispense the contents of the bottle. However, when the level of the contents in the bottle falls below a certain level, the pump is no longer able to dispense said contents. This is frustrating to users because the contents at the bottom of the bottle cannot be easily dispensed, and users resort to taking the pump out of the bottle and shaking the contents out of the bottle, or users throw out the bottle with the unused contents, which is wasteful. Additionally, sometimes existing caps on container bottles (e.g., lotion bottles, liquid soap bottles) are difficult to use or break, making it difficult for users to dispense the contents of the container bottle.

SUMMARY

Accordingly, there is a need for an improved system for dispensing substantially all of the contents in a bottle container that uses an existing cap or existing dispensing pump, that can be attached to such preexisting bottle containers, and that can be used with different size bottles.

In accordance with one embodiment, a universal adapter assembly system for container bottles is provided. The system comprises a plurality of adapter members, each adapter member sized to receive and couple to a container bottle having a different sized bottle neck from which an existing dispensing pump or existing bottle cap is removed. The system also comprises a base member having a body sized to fit each of the plurality of adapter members and releasably coupleable to each of the plurality of adapter members. The base member comprises a cap movable between an open position and a closed position relative to the body, the cap having an outer portion configured to support the container bottle in an upside down orientation on a supporting surface.

In accordance with another embodiment, a universal adapter assembly kit for container bottles is provided. The kit comprises a plurality of adapter members, each adapter member having a threaded opening of a different size for receiving and coupling to container bottles having a different sized bottle necks. The kit also comprises a base member having a body sized to fit and releasably couple to each of the plurality of adapter members. The kit also comprises a cap releasably coupleable to the base member body and movable between an open position and a closed position relative to the body. The cap has an outer portion configured to support the container bottle in an upside down orientation on a supporting surface.

BRIEF DESCRIPTION OF THE DRAWINGS

FIGS. 5A-5C are schematic bottom, side and top views of one embodiment of an adapter member of the adapter assembly.

FIG. 6A-6C are schematic bottom, side and top views of another embodiment of an adapter member of the adapter assembly.

DETAILED DESCRIPTION

As used herein, "substantially all" means greater than 70%, greater than 80%, greater than 85%, greater than 90%, greater than 95%, greater than 97% or greater than 99%. Similarly, as used herein "substantially the same" means within 10% or less, within 5% or less, within 3% or less, within 1% or less, within 0.5% or less, or within 0.2% or less. Also, "substantially planar" as used herein means a surface that is within 10% or less, within 5% or less, within 3% or less, within 1% or less, within 0.5% or less, or within 0.2% or less of being planar or defining a plane.

FIGS. 1-10C show embodiments of an adapter system 100 for use with container bottles 400A, 400B of different sizes (e.g., that contain hand lotion, shampoo, hand soap or other dispensable materials). The adapter system 100 can include an adapter member 200A, 200B and a base member 300 to which the adapter member 200A, 200B can releasably couple.

Figure 1:
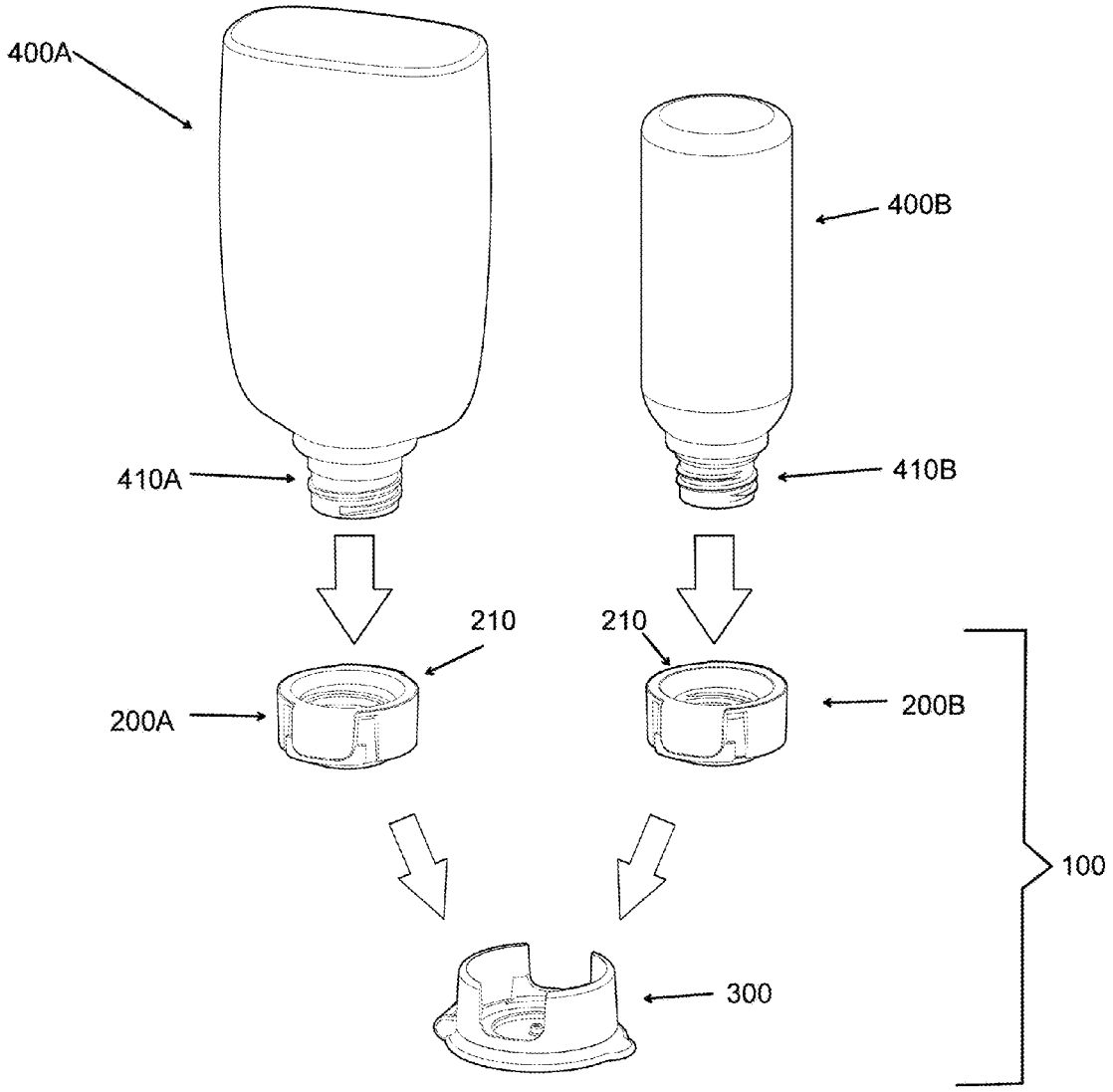
FIG. 1 is a schematic exploded view of one embodiment of an adapter assembly for use with bottle containers of different sizes.

As shown in FIG. 1, the system 100 can include multiple adapter members 200A, 200B, each having a fastener 210 sized to fit and couple to a threaded bottle neck of a particular size. In the illustrated embodiment, two adapter members 200A, 200B are shown. However, in other embodiments, the adapter system 100 can have more than two adapter members. For example, the fastener 210 of the adapter member 200A can be larger to fit and couple to a container bottle 400A with a larger bottle neck 410A, and the fastener 210 of the adapter member 200B can be smaller to fit and couple to a smaller bottle neck 410B. Advantageously, the outer dimensions of the adapter members 200A, 200B are substantially the same so that the multiple adapter members 200A, 200B can releasably couple to the same base member 300. In the illustrated embodiment, the fastener 210 is a threaded portion that can releasably couple to a corresponding threaded portion of the bottle neck 410A, 410B of the container bottle 410A, 410B. However, in other embodiments, the fastener can be a clamp, snap, rubber compression ring, press-fit connector or other suitable fasteners that can removably couple the adapter member 200A, 200B to the bottle 400A, 400B.

Figure 2A:
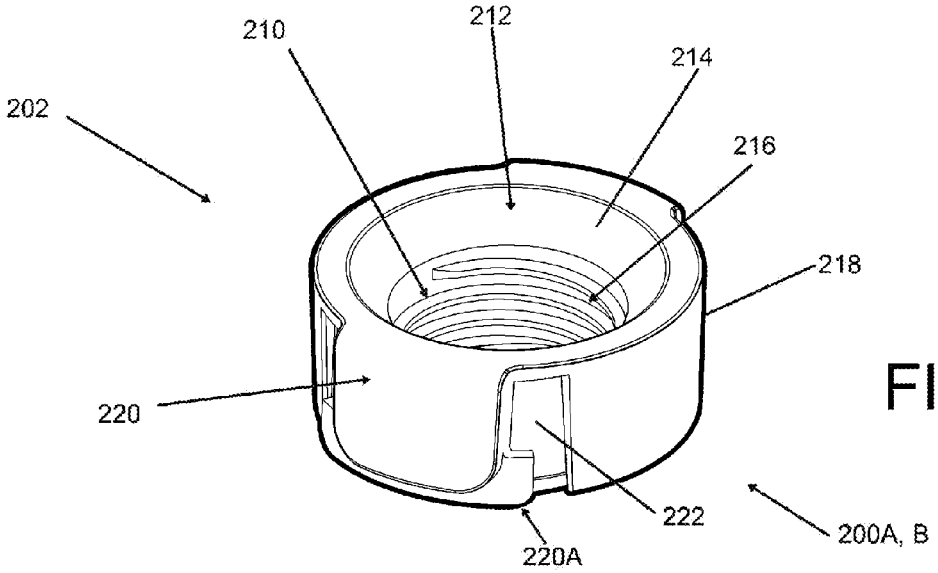
FIG. 2A is a schematic perspective top view of one embodiment of an adapter member of the adapter assembly, the adapter member coupleable to a bottle container.
Figure 2B:
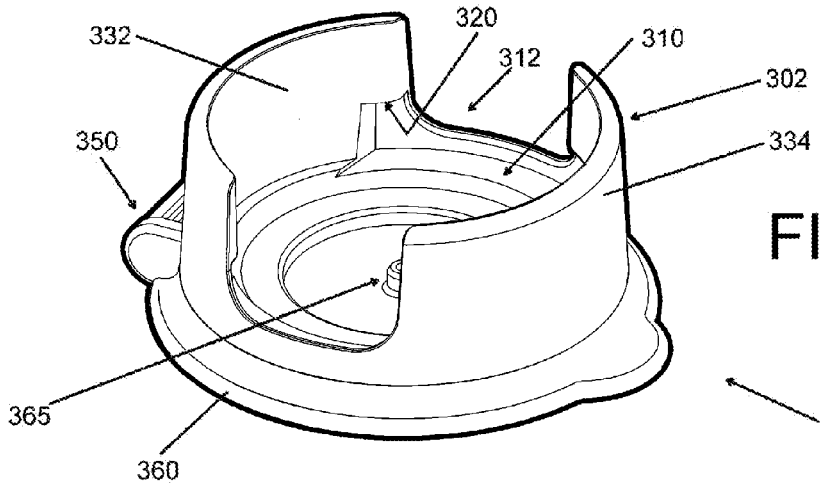
FIG. 2B is a schematic perspective view of one embodiment of a base member of the adapter assembly, the base member coupleable to the adapter member of FIG. 2A.
Figure 2C:
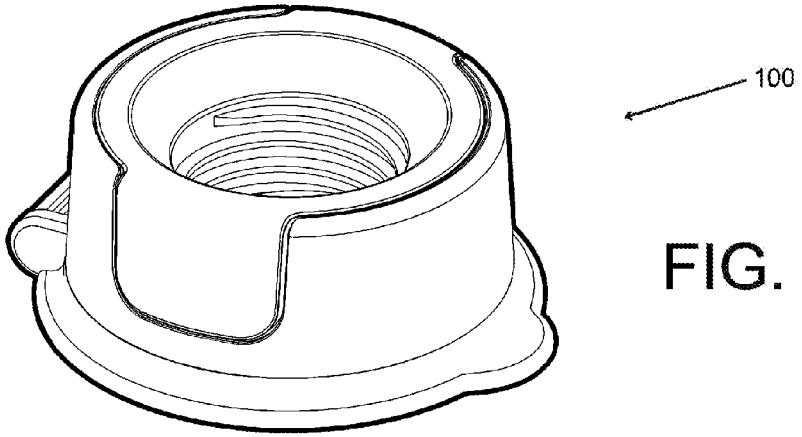
FIG. 2C is a schematic perspective view of the adapter member of FIG. 2A and the base member of FIG. 2B when assembled into the adapter assembly.
Figure 3A:
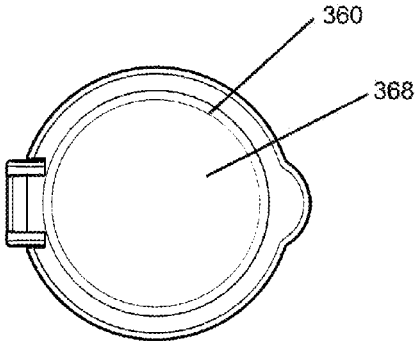
FIG. 3A is a bottom view of the assembled adapter assembly.
Figure 3B:
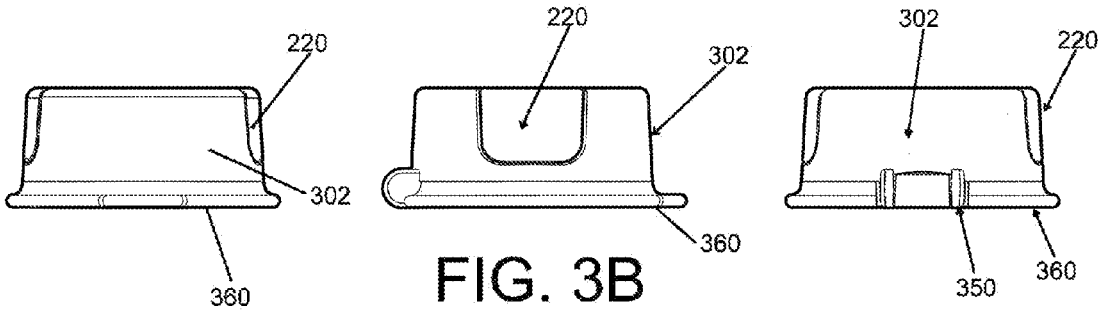
FIG. 3B are side views of the adapter assembly at different rotational orientations.
Figure 3C:
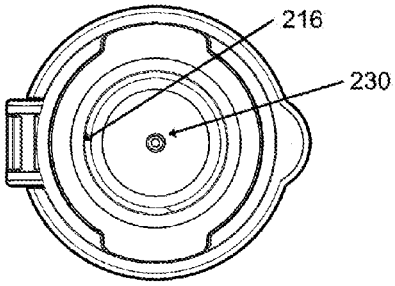
FIG. 3C is a top view of the assembled adapter assembly.
Figure 4A:
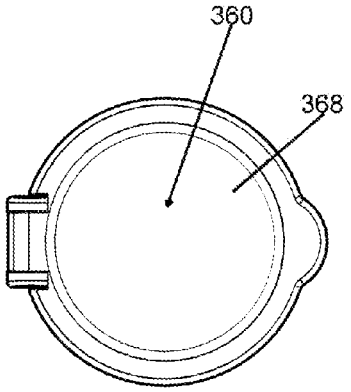
FIG. 4A is a bottom view of the base member of the adapter assembly.
Figure 4B:
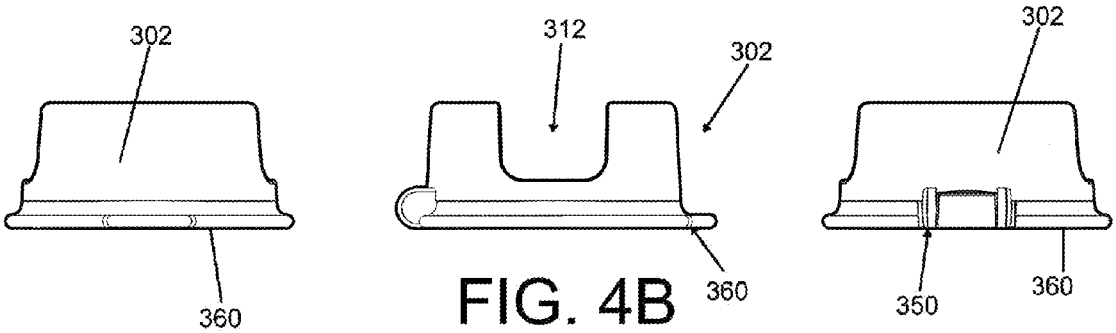
FIG. 4B are side views of the base member at different rotational orientations.
Figure 4D:
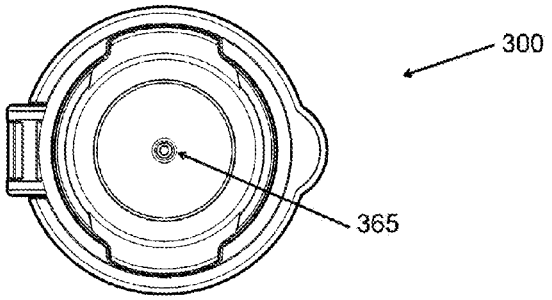
FIG. 4D is a top view of the base member.
Figure 4C:
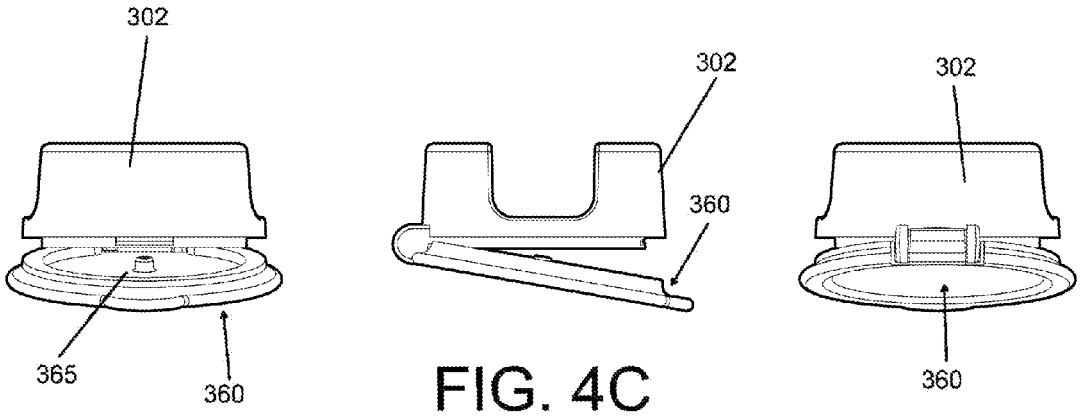
FIG. 4C are side views of the base member at different rotational orientations with the cover partially open.

With reference to FIGS. 2A-2C, the adapter member 200A, 200B can have a body 202 with an opening 212 and a tapered wall 214 that can facilitate alignment of the bottle neck 410A, 410B of the container bottle 400A, 400B with the fastener 210. In the illustrated embodiment, the fastener 210 is a threaded portion 216 with a diameter that can receive and threadably couple to the bottle neck 410A, 410B of the container bottle 400A, 400B. Advantageously, each of the multiple adapter members 200A, 200B can have a different sized opening to accommodate a different sized bottle neck. In the illustrated embodiment, the body 202 can have an outer wall surface 218 that is generally cylindrical and spaced from an inner wall surface 222 of the body 202. The body 202 can also have a coupling mechanism 220 that can couple the adapter member 200A, 200B to the base member 300. In the illustrated embodiment, the coupling mechanism 220 can include a pair of push tabs 220 on two sides of the body 202 (e.g., on opposite sides of the body 202), spaced apart from the inner wall portion 222 and actuatable (e.g., manually actuatable by a user pressing on the push tabs 220 with their fingers) to move the push tabs 220 toward the inner wall portion 222 from a default (e.g., unloaded) position. When the user removes their fingers from the push tabs 220, the push tabs 220 can move away from the inner wall portion 222 toward their default position. The push tabs 220 can include a snap tab 220A that can engage a portion of the base member 300 when the adapter member 200A, 200B is coupled to the base member 300, as further discussed below. In another embodiment, the coupling mechanism 220 of the adapter member 200 can be other suitable types, such as a threaded portion that can threadably couple to the base member 300.

With continued reference to FIGS. 2A-2C, the base member 300 can have a body 302 that can removably couple to the adapter members 200A, 200B. In the illustrated embodiment, the body 302 can have a top opening 310 to receive the body 202 of the adapter member 200A, 200B and a pair of side openings 312 to receive the push tabs 220 therein. The body 302 can have a recessed portion 320 (e.g., undercut) on an inner surface 332 of the body 302 near each of the side openings 312, where the recessed portion 320 is sized to receive and engage the snap tabs 220A of the push tabs 220 in order to couple (e.g., hold together) the adapter member 200 to the base member 300. When the push tabs 220 are actuated (e.g., manually pushed) by the user, the snap tabs 220A can disengage and clear the recessed portion 320 to allow the adapter member 200 to be removed from the base member 300. The body 302 can also have a hinge 350 to which a cap or cover 360 can be coupled so that the cap 360 can be moved between an open position, to allow material to pass through a port 230 (see FIG. 3C) in the bottom of the body 202 of the adapter member 200, and a closed position, where the port 230 of the adapter member 200 is closed by a plug 365 of the cap 360. In another embodiment, the hinge 350 can be a living hinge. In still another embodiment, the body 302 and cover 360 can be a single (e.g., monolithic) piece. Other suitable mechanisms for the hinge can be used and are contemplated in the instant application. The cap 360 can have an outer portion 368 that can support the adapter assembly 100 when coupled to the container bottle 400A, 400B in an upside down orientation. In one embodiment, the cap 360 can have a substantially planar outer surface with a diameter greater than a diameter of the body 302. The planar outer surface 368 of the cap 360 advantageously provides a stable base so that when the adapter assembly 100 is coupled to the container bottle 400A, 400B, the bottle 400A, 400B can be turned upside down and supported on a surface (e.g., table, counter) via the outer surface 368.

Figure 7A:
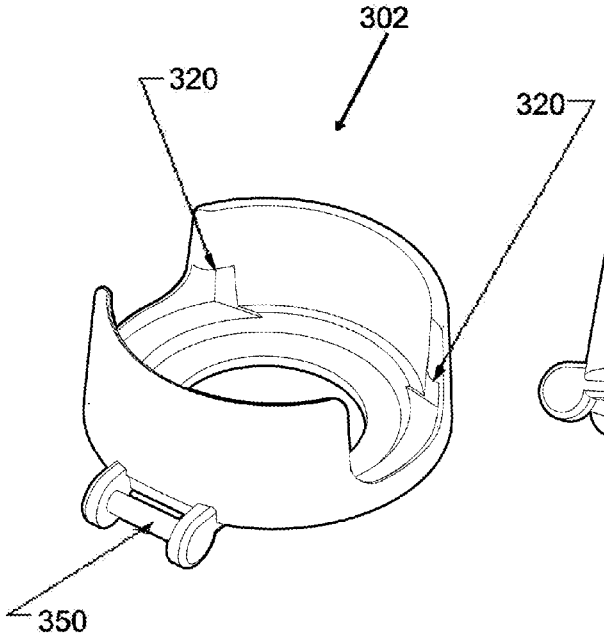
FIG. 7A is a schematic perspective top view of one embodiment of a base member of the adapter assembly without the cap cover.
Figure 7B:
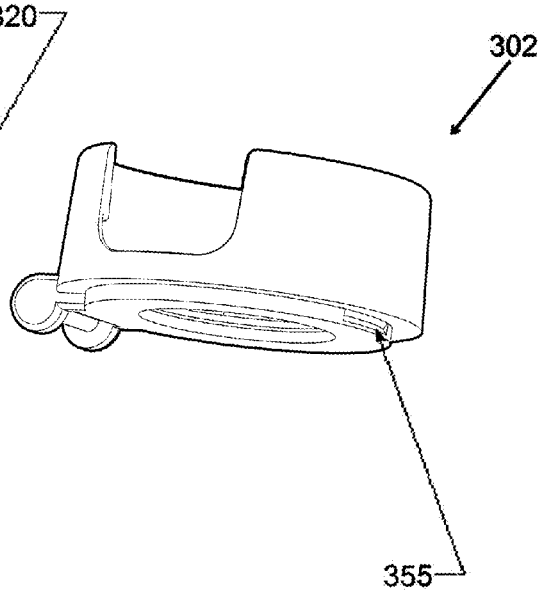
FIG. 7B is a schematic perspective side view of the base member of FIG. 17A.
Figure 8:
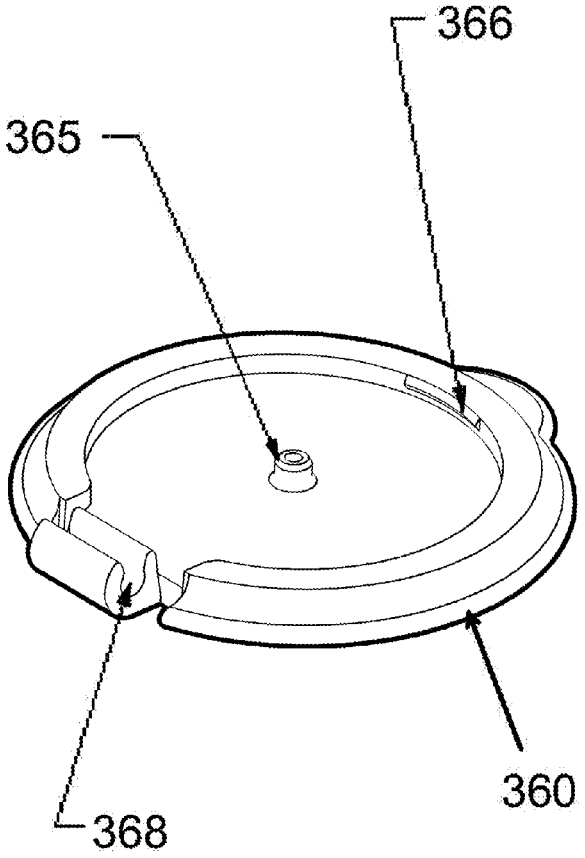
FIG. 8 is a schematic perspective top view of the cap cover for use with the base member of the adapter assembly.

With reference to FIGS. 7A-7B, the body 302 of the base member 300 can have an undercut portion 355 on a side of the body 302 (e.g., on an opposite side from the hinge 350) that can couple to a snap 366 on the cap 360 (see FIG. 8). The cap 360 can have a clamp member (e.g. c-shaped clamp) that can movably couple (e.g. releasably couple) to the hinge 350 of the body 302. Other suitable mechanisms for coupling the cap 360 to the body 302 can be used. As noted above, in other embodiments, the cap 360 and body 302 can be a single (monolithic) piece.

Figures 9A, 9B, 9C:
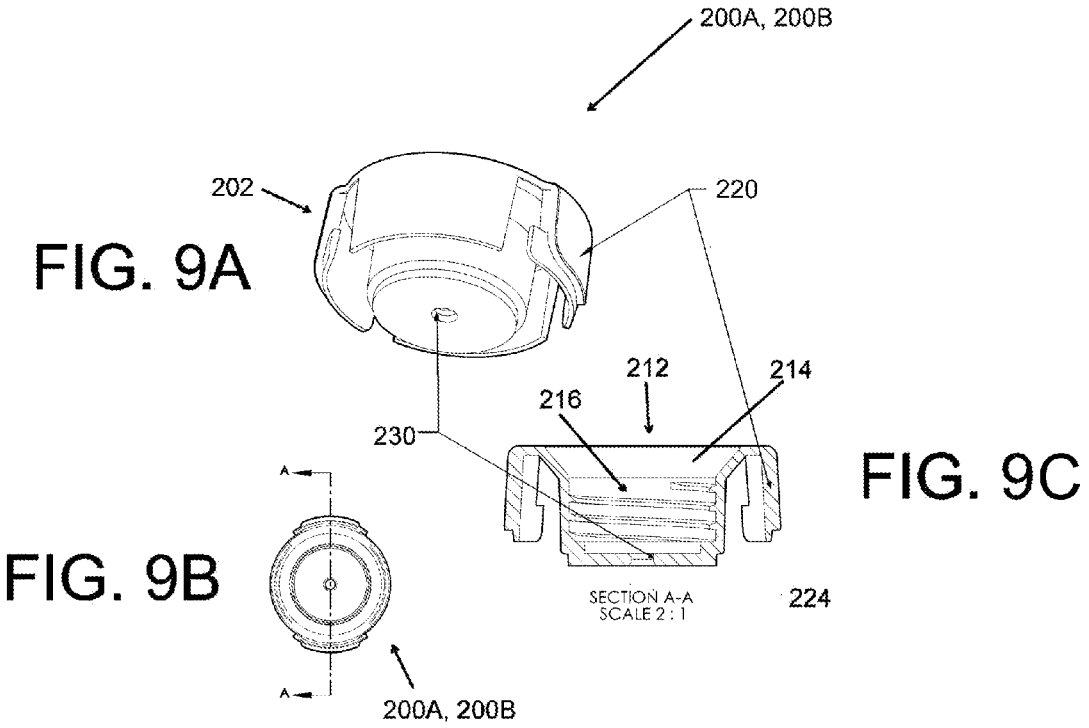
FIG. 9A is a schematic bottom perspective view of one embodiment of an adapter member of the adapter assembly.
FIG. 9B is a schematic top planar view of the adapter member of FIG. 9A.
FIG. 9C is a cross-sectional view of the adapter member of FIG. 9B along plane A-A.

FIGS. 9A-9C show other views of one embodiment of the adapter member 200A, 200B. In one embodiment, the port 230 in the body 202 can have a diameter of between about 2 mm and about 4 mm, inclusive of any dimensions therebetween. In another embodiment, the diameter of the port 230 can be about 3.5 mm. However, the diameter can have other suitable dimensions, such as about 3.6 mm. Other suitable dimensions are possible. The push tabs 220 can be spaced from the inner wall surface 222 of the body 202 by a distance 224 of between about 2 mm and about 10 mm, inclusive of dimensions therebetween. In another embodiment, said distance 224 can be about 5 mm or about 6 mm or about 7 mm, or any dimension in between these. Other suitable dimensions are possible.

In some embodiments, the adapter system 100 can be made of a plastic material and made using methods known in the art (e.g., molding such as injection molding, cast molding). In such molding operations, a tool can be used to form the different features of the components of the system 100 (e.g., to mold the push tabs 220 and snap tabs 220A). However, the adapter system 100 can be made of other suitable materials (e.g., metal).

In use, once the user is unable to dispense the contents of a bottle container with its associated pump (e.g., because the level of the contents in the bottle is too low for the pump to pull the contents out of the bottle), the user can remove the pump from the container and attach one of the adapter members 200A, 200B that fits the bottle neck of the container bottle. The user can then couple the base member 300 to the adapter member 200A, 200B to provide the assembled adapter system 100. The user can then turn the bottle container upside down and rest the bottle on the cap 360 to allow gravity to bring the contents of the bottle toward the cap 360. When ready to use, the user can open the cap 360 and squeeze or shake the bottle to dispense the contents. When finished, the user can move the cap 360 to the closed position and place the container in the upside down position again.

Of course, the foregoing description is of certain features, aspects and advantages of the present invention, to which various changes and modifications can be made without departing from the spirit and scope of the present invention. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or sub-combinations of the specific features and aspects between and among the different embodiments may be made and still fall within the scope of the invention. Accordingly, it should be understood that various features and aspects of the disclosed embodiments can be combined with or substituted for one another in order to form varying modes of the discussed devices, systems and methods (e.g., by excluding features or steps from certain embodiments, or adding features or steps from one embodiment of a system or method to another embodiment of a system or method).

What is claimed is:

1. A universal adapter assembly system for container bottles, comprising:

a plurality of adapter members, each adapter member sized to receive and couple to a container bottle having a different sized bottle neck from which an existing dispensing pump or existing bottle cap is removed;

a base member having a body sized to fit each of the plurality of adapter members and releasably coupleable to each of the plurality of adapter members, the base member comprising a cap movable between an open position relative to the body and a closed position relative to the body, the cap having an outer portion configured to support the container bottle in an upside down orientation on a supporting surface, wherein each adapter member has a pair of push tabs actuatable by a user to releasably couple the adapter member to the base member.

2. The system of claim 1, wherein each adapter member has a threaded portion that threadably couples to a threaded neck portion of the container bottle.

3. The system of claim 1, wherein each push tab comprises a snap tab that releasably engages an undercut recessed portion of the base member to couple the adapter member to the base member.

4. The system of claim 1, wherein the cap comprises a plug configured to seal a port defined in the adapter member and through which contents of the container bottle are dispensed when the cap is in the open position relative to the base member.

5. The system of claim 1, wherein the cap includes a clamp that releasably couples the cap to a hinge of the base member body.

6. The system of claim 1, wherein the base member has side openings sized to receive the push tabs therein.

7. The system of claim 1, wherein the cap includes a snap fastener configured to releasably couple to an undercut portion of the base member body to releasably retain the cap in the closed position relative to the base member body.

8. The system of claim 1, wherein the outer portion is a substantially planar outer surface.

9. A universal adapter assembly kit for container bottles, comprising:

a plurality of adapter members, each adapter member having a threaded opening of a different size for receiving and coupling to container bottles having a different sized bottle necks;

a base member having a body sized to fit and releasably couple to each of the plurality of adapter members; and a cap releasably coupleable to the base member body and movable between an open position and a closed position relative to the body, the cap having an outer portion configured to support the container bottle in an upside down orientation on a supporting surface, wherein each adapter member has a pair of push tabs actuatable by a user to releasably couple the adapter member to the base member.

10. The kit of claim 9, wherein each push tab comprises a snap tab that releasably engages an undercut recessed portion of the base member to couple the adapter member to the base member.

11. The kit of claim 9, wherein the cap comprises a plug configured to seal a port defined in the adapter member and through which contents of the container bottle are dispensed when the cap is in the open position relative to the base member.

12. The kit of claim 9, wherein the cap includes a clamp that releasably couples the cap to a hinge of the base member body.

13. The kit of claim 9, wherein the base member has side openings sized to receive the push tabs therein.

14. The kit of claim 9, wherein the cap includes a snap fastener configured to releasably couple to an undercut portion of the base member body to releasably retain the cap in the closed position relative to the base member body.

15. The kit of claim 9, wherein the outer portion is a substantially planar outer surface.

* * * * *